US005435035A

United States Patent [19]

Fujimoto et al.

[11] Patent Number: 5,435,035

[45] Date of Patent: Jul. 25, 1995

[54] FLOOR TREATING MACHINE

[75] Inventors: Tadayoshi Fujimoto, Yao; Yoshio Miyazaki; Nobuyoshi Kumaki, both of Oomiya, all of Japan

[73] Assignee: Penguin Wax Co., Ltd., Osaka, Japan

[21] Appl. No.: 898,578

[22] Filed: Jun. 15, 1992

[30] Foreign Application Priority Data

Apr. 1, 1992 [JP] Japan ..... 4-079965
Apr. 1, 1992 [JP] Japan ..... 4-079966

[51] Int. Cl.[6] ..... A47L 11/162
[52] U.S. Cl. ..... 15/49.1; 15/98
[58] Field of Search ..... 15/49.1, 98; 51/177

[56] References Cited

U.S. PATENT DOCUMENTS 4,122,576 10/1978 Bevington et al. ..... 15/98
4,339,841 7/1982 Waldhauser et al. ..... 15/98
4,483,041 11/1984 Waldhauser et al. ..... 15/98
4,674,142 6/1987 Meili ..... 15/49.1
4,805,258 2/1989 Sitarski et al. ..... 15/49.1
4,900,881 2/1990 Fischer .

FOREIGN PATENT DOCUMENTS 248623 5/1963 Australia .
251782 5/1963 Australia .
255517 5/1963 Australia .
437509 9/1971 Australia .
0139241 5/1985 European Pat. Off. .
0282707 9/1988 European Pat. Off. .
0378120 7/1990 European Pat. Off. .
3911759 11/1989 Germany .
61-43051 9/1986 Japan .
62-1004 1/1987 Japan .
2-74227 3/1990 Japan .
9010415 9/1990 WIPO ..... 15/49.1
91-04701 4/1991 WIPO .

*Primary Examiner*—Mark Spisich
*Attorney, Agent, or Firm*—Gifford, Krass, Groh, Sprinkle, Patmore, Anderson & Citkowski

[57] ABSTRACT

A floor treating machine includes an electric motor, batteries free from leakage and mounted on a motor deck for supplying a current to the electric motor, a rotary shaft extending vertically and driven by the electric motor, and a floor treating device, such as a brush or sponge, detachably attached to a lower end of the rotary shaft to be rotatable therewith. The floor treating device contacts a floor and supports the machine during a floor treating operation. The electric motor is connected to the batteries through an on/off switch. The floor treating machine further includes a rotating rate varying device operable upon start of the electric motor for gradually increasing a rotating rate of the electric motor to reach a predetermined operational rotating rate after lapse of a predetermined time.

2 Claims, 15 Drawing Sheets

FLOOR TREATING MACHINE

BACKGROUND OF THE INVENTION

1. FIELD OF THE INVENTION

This invention relates to a floor treating machine for cleaning or polishing floor surfaces, and more particularly to a floor treating machine having a floor treating device such as a brush or sponge attached for unitary rotation to a lower end of a vertical rotary shaft driven by an electric motor, the floor treating device supporting the entire machine during a floor treating operation.

2. DESCRIPTION OF THE RELATED ART

Conventionally, this type of floor treating machine has four wheels which constantly engage a floor surface since the machine carries a heavy battery running a risk of damaging a carpet or other floor material with liquid leakage. The machine cleans the floor by rotating the brush with the four wheels constantly engaging the floor, i.e. with the four wheels bearing a large part or the whole of the machine's weight.

DC type floor treating machines having the wheels in constant engagement with the floor include a push type and a self-propelled type. These types invariably are movable with the four wheels engaging the floor, and are therefore not capable of making small sharp turns. Such machines are not suited for cleaning corners or narrow areas. Moreover, since the entire machine is large and heavy and with the possibility of leakage from the battery, it is difficult to transport the machine upstairs from the first floor to the second floor or from the second floor to the third floor, or downstairs from the second floor to the first floor or from the third floor to the second floor, and to store the machine when out of use.

To overcome such inconveniences, various types of floor treating machines have been proposed which are capable of small sharp turns and easy to transport upstairs and downstairs. These machines are used to clean floors with wheels maintained out of contact with the floors.

This type of machines, which have the wheels out of contact with the floors when in use, are all AC-operated and have a long power cord. Such machines are extremely cumbersome in use, with the long power cord constantly obstructing movement of the machine during a cleaning operation.

SUMMARY OF THE INVENTION

The object of the present invention is to eliminate the disadvantages of the prior art noted above, and provide an improved floor treating machine for cleaning and polishing floor surfaces. This machine utilizes small, sealed, high-rate discharge, lead storage batteries or the like which are (1) high-power, (2) maintenance-free, (3) leakage-free, and (4) usable in any mounting direction and in any moving direction.

The above object is fulfilled, according to the present invention, by a floor treating machine for use in cleaning a floor without wheels contacting the floor and having a manual control handle, in which small secondary storage batteries free from leakage are mounted on a motor deck for supplying a current to an electric motor, and the secondary batteries are connected to the electric motor through an on/off switch.

This floor treating machine has the following functions and effects:

The above construction according to the present invention can dispense with the four wheels constantly engaging the floor as well as the power cord. The entire weight of the machine is received by a floor treating device such as a brush which is rotated to clean or polish the floor.

In the absence of the four wheels constantly engaging the floor and the power cord, the floor treating machine according to the present invention is capable of small sharp turns and is suited for cleaning corners and other narrow areas. Moreover, since this floor treating machine is small and lightweight and has no power cord, the machine is easy to handle, including transportation upstairs and downstairs. The leak-free batteries assure safety to contribute toward the excellent practical utility of the floor treating machine.

The floor treating machine according to the present invention may further comprise a rotating rate varying device operable upon start of the electric motor for gradually increasing rotating rate of the electric motor to reach a predetermined operational rotating rate after lapse of a predetermined time.

With this construction, when the electric motor is started with the entire weight of the machine borne by the floor treating device such as a brush or sponge attached to the lower end of the vertical rotary shaft and contacting the floor, the rotating rate of the electric motor, and thus the rotary shaft, is gradually increased and does not reach a predetermined operational rotating rate before lapse of a predetermined time. This predetermined time may be a period of time considered desirable for allowing the operator to adjust an operating stance or the like after starting the electric motor. The floor treating device starts rotating slowly under a strong contacting pressure with the machine weight falling thereon. This allows the operator to adjust the operating stance before the rotating rate increases to the predetermined operational rotating rate. During this preparatory period, the machine may remain unsteady due to a reaction from the frictional resistance of the floor treating device. However, the entire machine may undergo only slight vibrations instead of shaking violently.

Consequently, although the machine is small, an effective pressure acts on the floor to achieve excellent treatment by the entire machine weight falling on the floor treating device itself which contacts the floor. At the same time, the machine vibrates only to a minor degree when the electric motor is started, thereby allowing the operator to adjust an operating stance after starting the motor for improved operating safety.

In a further aspect of the present invention, the floor treating machine employs an improved battery mounting structure. That is, the floor treating machine has a rotary brush attached to a main machine body including an electric motor for driving the rotary brush, a control unit for controlling the electric motor, and a power source section. The power source section includes a power receiving section provided on the main body, and a battery assembly detachably attached to the power receiving section. The power receiving section includes a fixing device for fixing the battery assembly, and connecting terminals automatically connectable to contact terminals of the battery assembly fixed in place.

The battery assembly may include a plurality of batteries and a battery case for accommodating the batteries, the contact terminals being electrically connected to the batteries and exposed outwardly of the battery case.

This construction advantageously provides the following functions and effects.

The electric contacts are connected and disconnected automatically with attachment and detachment of the battery assembly relative to the main body. This feature dispenses with the trouble of connecting or disconnecting the batteries to/from the control unit each time the batteries are attached or detached, thereby greatly simplifying the battery attaching and detaching operations.

In addition, the battery assembly having the battery case facilitates battery attaching and detaching operations where a plurality of batteries are used. Such battery assembly can readily accommodate batteries of different specifications such as having terminals located in different positions.

Other features and advantages of the present invention will be apparent from the following description of the preferred embodiments.

DETAILED DESCRIPTION OF THE PREFERRED EMBODIMENTS

A floor treating machine embodying the present invention will be described in detail with reference to the drawings.

Figure 1:
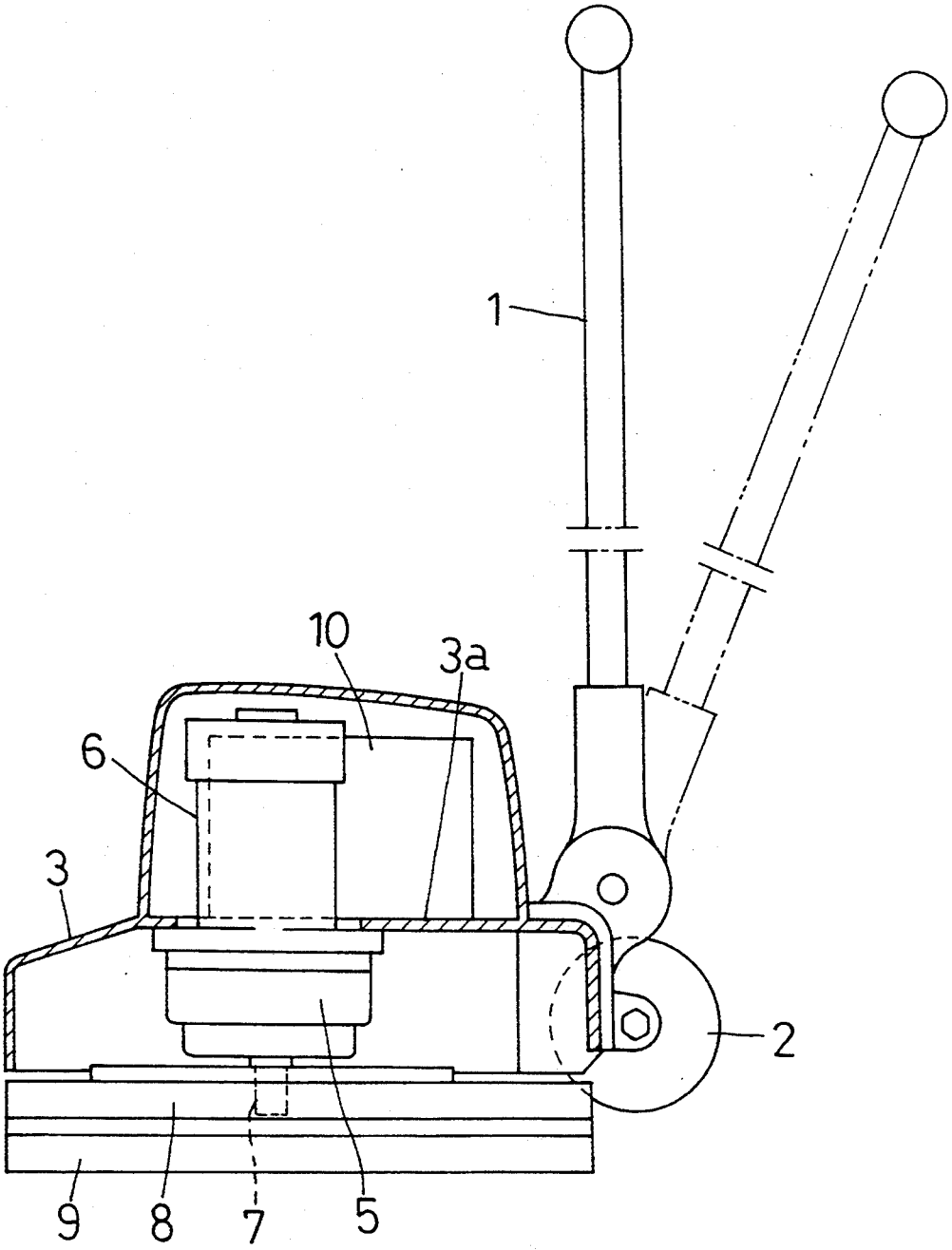
FIG. 1 is a side view, partly in section, of a floor treating machine according to the present invention.
Figure 2:
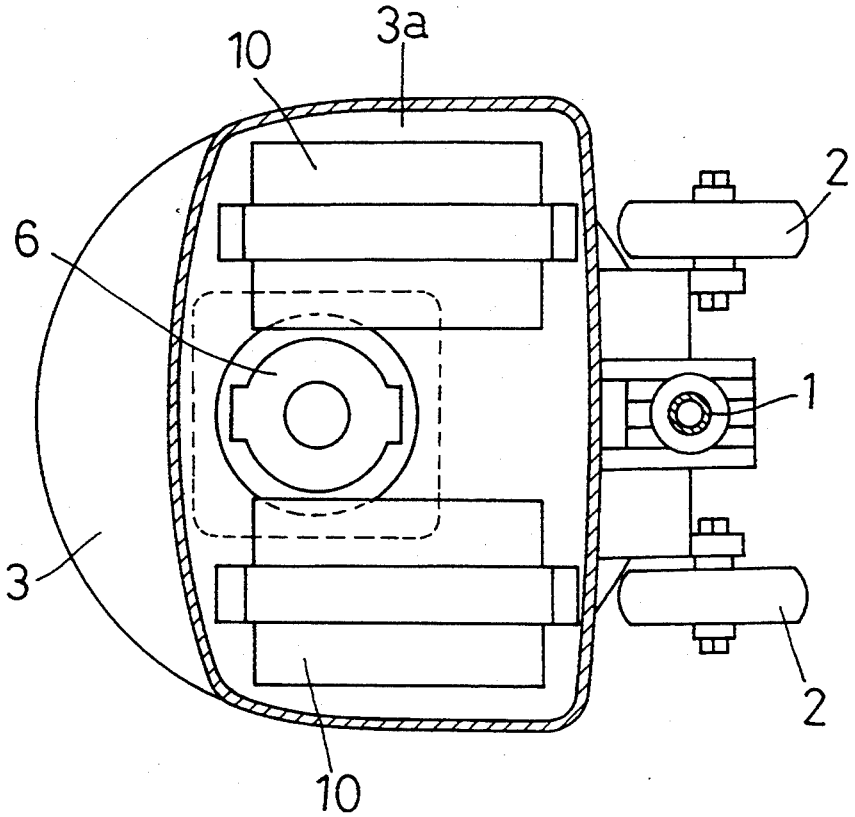
FIG. 2 is a plan view, partly in section, of the floor treating machine.
Figure 3:
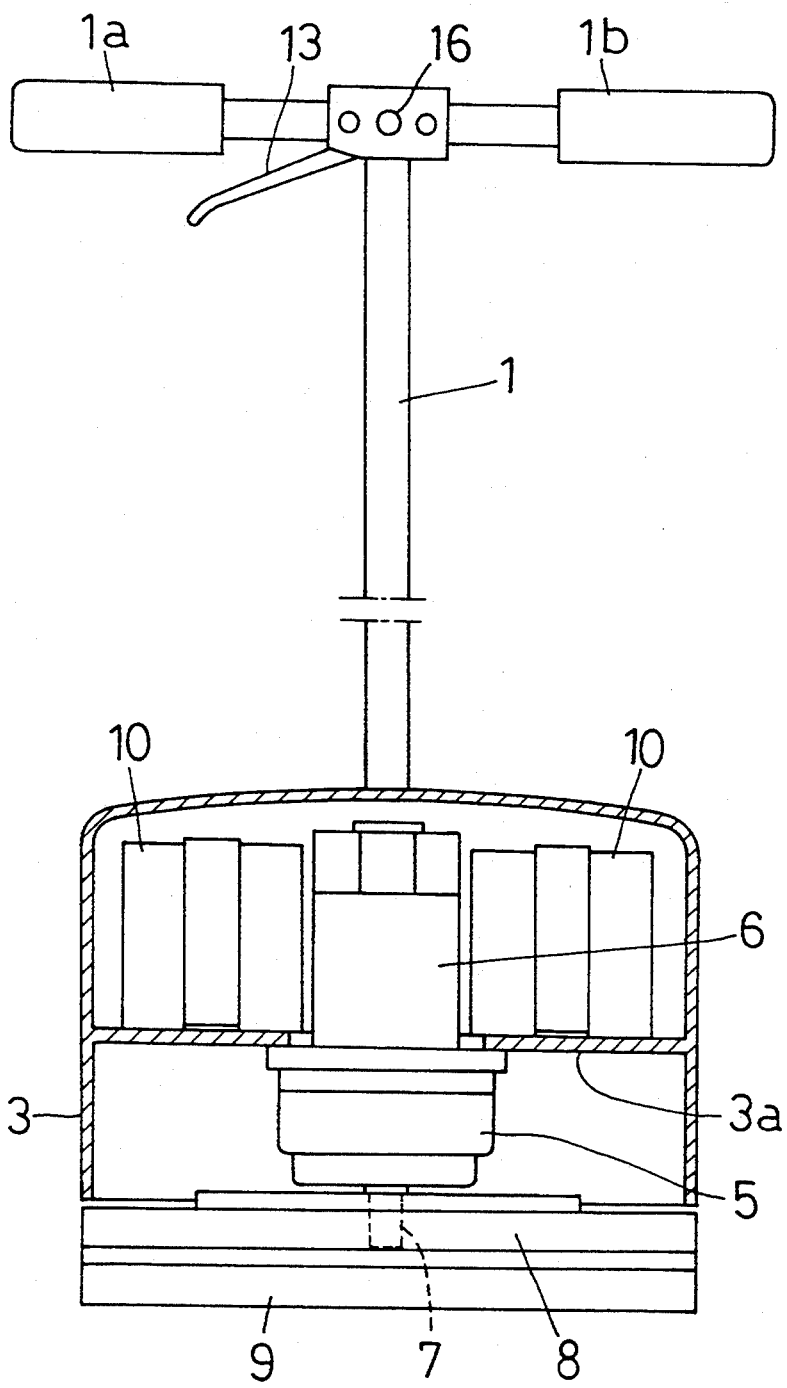
FIG. 3 is a front view, partly in section, of the floor treating machine.

Referring to FIGS. 1 through 3, the floor treating machine has a manual control handle 1 extending upward from a rear position of a machine body to be switchable between an inclined use state (shown in phantom lines in FIG. 1) and an upright non-use state (shown in solid lines in FIG. 1). Casters 2 are connected to lower rear positions of the machine body, which are placed in contact with a floor when moving the machine from one location to another. The machine body includes a motor deck 3*a* having a skirt-like frame 3 extending around an entire peripheral edge thereof. A DC motor 6 having a speed reducer 5 is mounted substantially centrally of the deck 3*a*, with a rotary shaft 7 extending downwardly. A brush holder 8 is detachably secured to a lower end of the rotary shaft 7, and a brush 9 is interchangeably attached to a lower surface of the brush holder 8 to act as a floor treating device. The brush 9 may be a wire brush, a sponge brush, a brush with abrasive particles mixed into sponge, a felt brush, a cloth brush, or other type of brush.

The motor deck 3*a* supports a pair of small, sealed, high-rate discharge, 12V lead storage batteries 10 fixedly arranged on an upper surface thereof and on opposite sides of the electric motors 6. Each of these batteries 10 is a rectangular parallelepiped 98×98×150 mm. Preferably, ABS resin is used for forming battery cases, and then each battery is as light as 4 kg.

Electrical data of the batteries used in this embodiment are shown in Table 1 below.

TABLE 1

| nominal voltage (V) | nominal capacity (Ah/10 hr) | internal resistance (mΩ) | charging method: use | charging method: initial charging current (A) | charging method: charging voltage (V) |
|---|---|---|---|---|---|
| 12 | 12 | about 16 | float | unlimited | 13.5–13.8 |
| | | | cycle | up to 3.0 | 14.4–15.0 |

As shown in FIG. 3, the handle 1 includes a lever type on/off switch 13 disposed between right and left grips 1*a* and 1*b*. The batteries 10, on/off switch 13 and other components are connected through an electric circuit as shown in FIG. 4.

Figure 4:
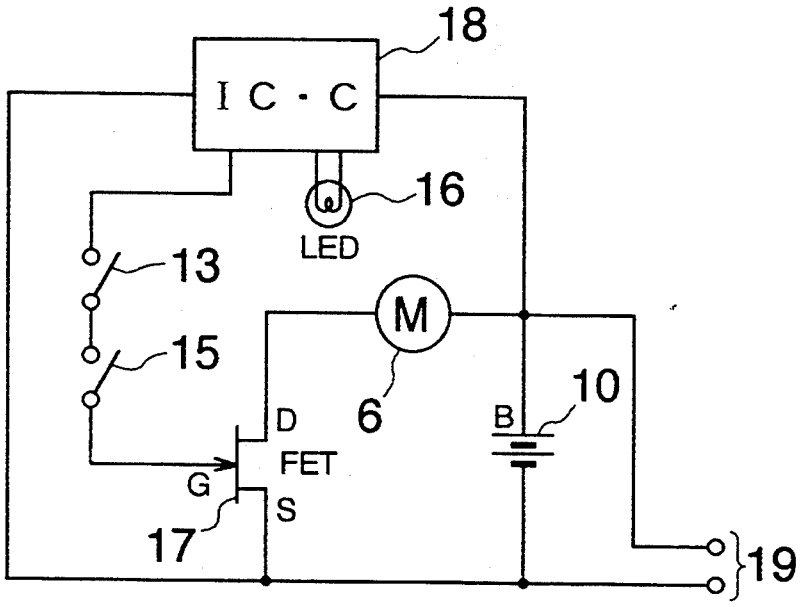
FIG. 4 is a diagram of an electric circuit.

The electric circuit of FIG. 4 connects the DC motor 6, batteries 10, on/off switch 13, low voltage indicator lamp 16, power MOSFET 17 and low voltage detector 18 as illustrated. When the voltage of the batteries 10 has lowered to a predetermined voltage through use, the low voltage detector 18 detects the voltage reduction and stops a current flowing between source S and drain D of the power MOSFET 17, thereby stopping the motor 6.

Numeral 15 in FIG. 4 denotes a safety switch which is turned off when the handle 1 is in the upright non-use state, and turned on when the handle 1 is in the inclined use state. Numeral 19 denotes charging terminals.

Another embodiment will be described next.

Figure 6:
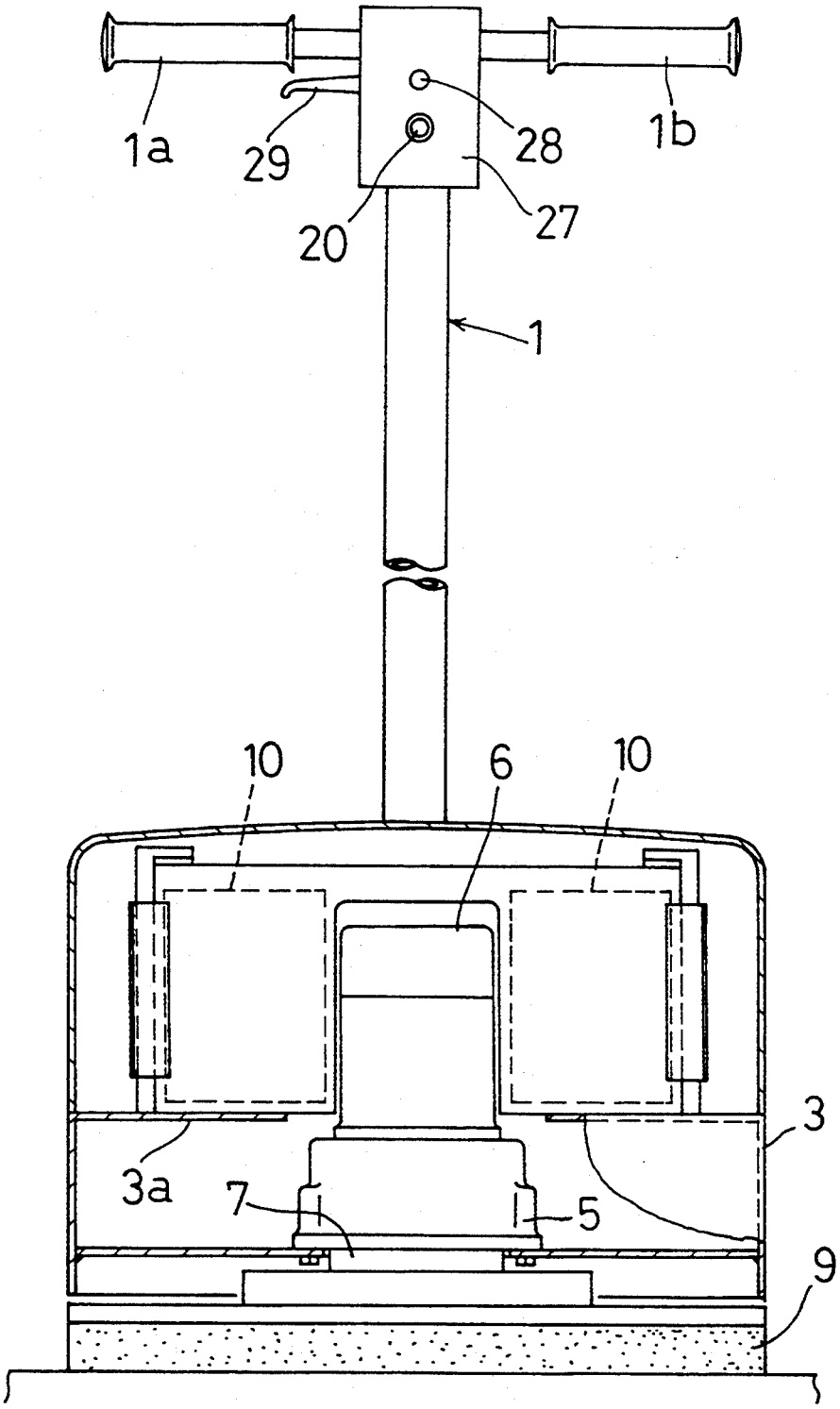
FIG. 6 is a front view, partly in section, of a floor treating machine having the electric circuit shown in FIG. 5.
Figure 7:
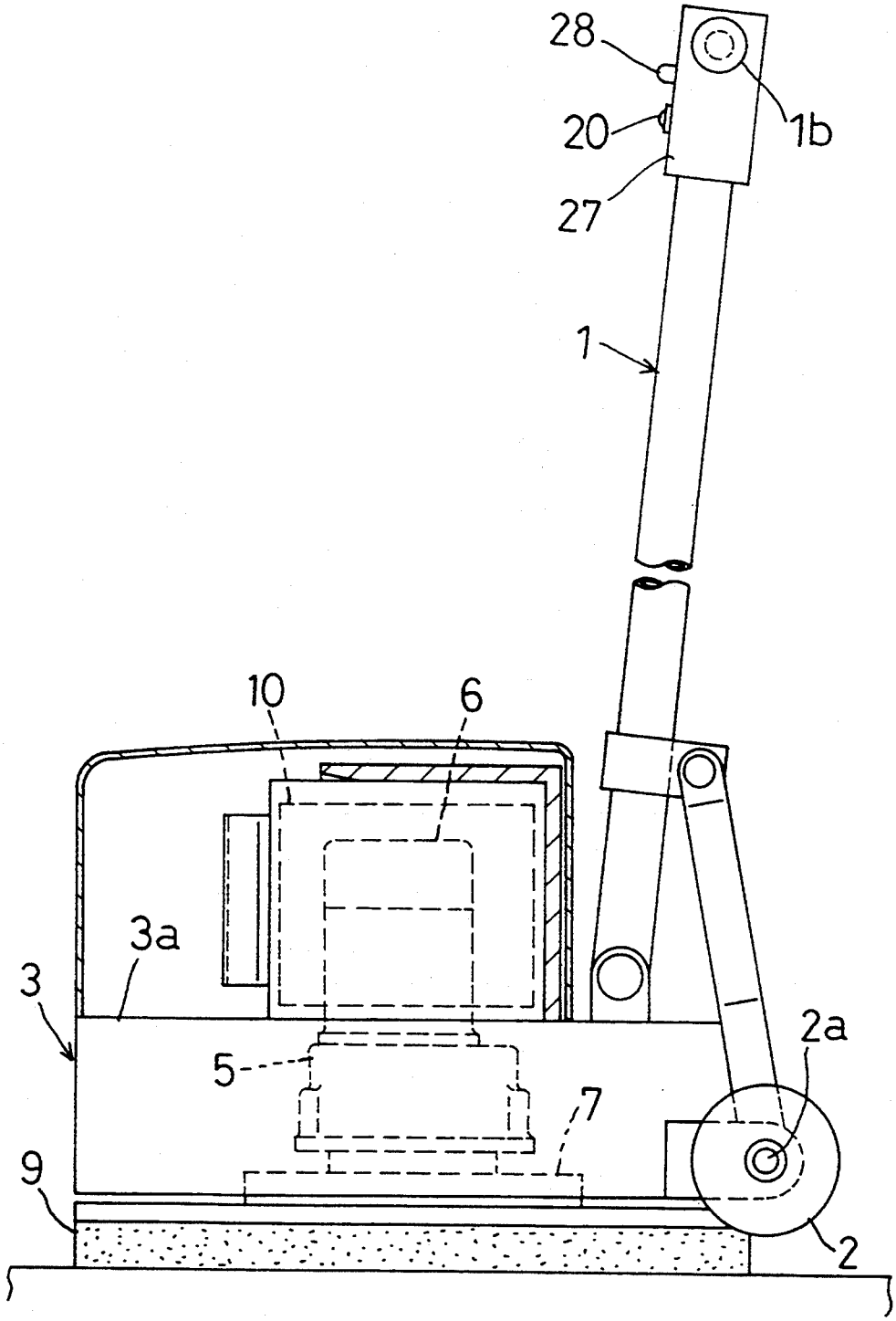
FIG. 7 is a side view, partly in section, of the floor treating machine shown in FIG. 6.
Figure 8:
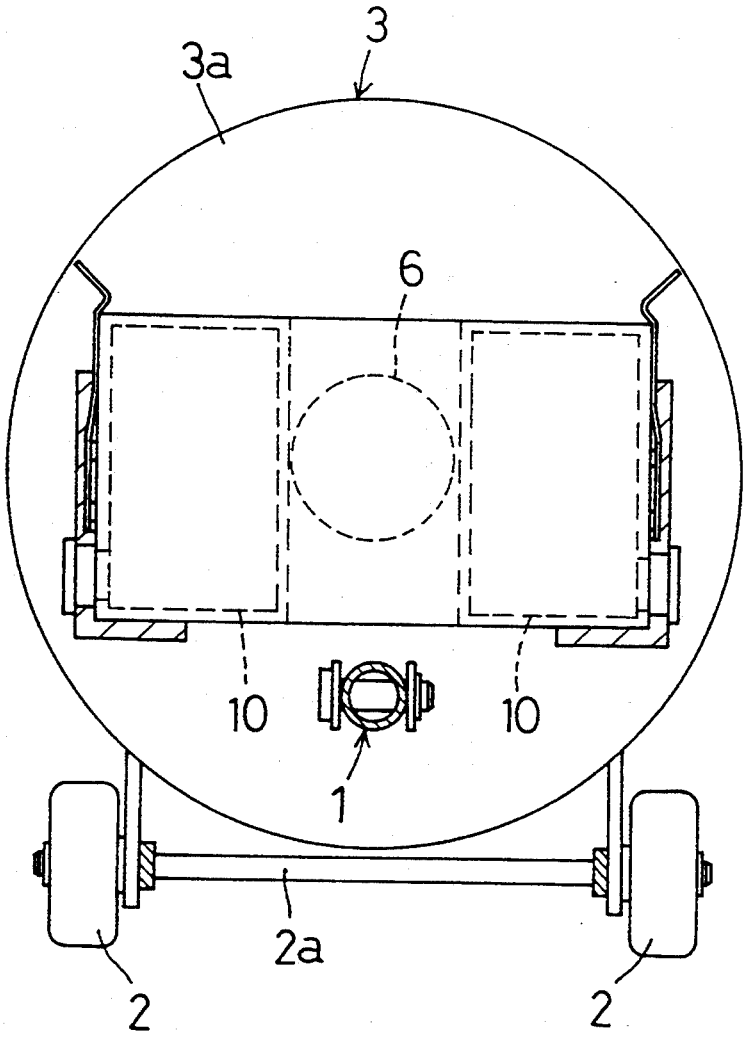
FIG. 8 is a plan view, partly in section, of the floor treating machine shown in FIG. 6.

As shown in FIGS. 6 through 8, a floor treating machine in this embodiment has a control handle 1 operable by a walking operator and fixed to a drum-shaped frame 3. The frame 3 includes a mounting deck 3*a* supporting a pair of right and left batteries 10. An electric motor 6 is mounted between the batteries 10, with a rotary shaft (not shown) of the motor 6 extending downwardly of the mounting deck 3*a*. A vertical rotary shaft 7 projects from a speed reducer 5 disposed below the mounting deck 3*a*, and a circular rotary brush 9 (one example of floor treating devices) is detachably attached to the rotary shaft 7. The rotary brush 9 is driven by the electric motor 6 to clean or polish a floor surface.

Further, a pair of right and left casters 2 are supported on a support shaft 2*a* disposed outwardly of the frame 3 adjacent a lower end of the control handle 1 to be fixable to the frame 3. When a floor treating operation is not carried out, the floor treating machine may be moved easily, with the entire weight thereof passed to the floor through the casters 2.

When the floor treating machine engages in an operation to clean or polish a floor surface with the rotary brush 9 mounted in place, a floor contacting portion of the rotary brush 9 uniformly contacts the floor to pass the entire weight of the machine to the floor while the brush 9 is driven to clean or polish the floor.

Figure 5:
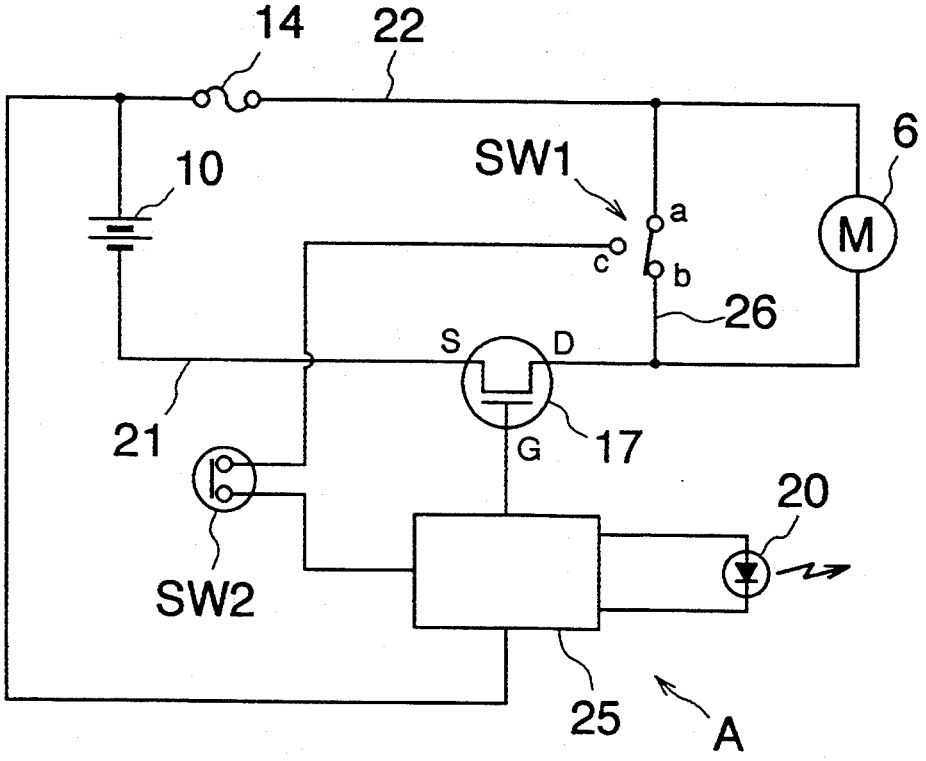
FIG. 5 is a diagram of an electric circuit in another embodiment.

This floor treating machine includes a rotating rate varying device A operable upon start of the electric motor 6 to increase rotating rate of the motor 6 so that a predetermined operational rotating rate is reached upon lapse of a predetermined time. Specifically, as shown in FIG. 5, positive and negative terminals of the batteries 10 are connected to terminals of the DC motor 6 through main wiring 21 and 22. The illustrated circuit includes a MOSFET (field effect transistor) 17 having a source terminal S and a drain terminal D connected to the main wiring 21. The other main wiring 22 has a fuse 14. A starter switch SW1 is mounted in a short-circuit line connecting a position of the wiring 21 between the drain terminal D of the FET 17 and the motor 6 to a position of the wiring 22 between the fuse 14 and the motor 6. The switch SW1 has a terminal connected to a control circuit 25 through a mercury switch SW2. The switch SW1 is a latch type switch which is set to an inoperative position with terminal "a" and terminal "b" connected to allow short-circuiting through the short-circuit line 26. As shown in FIGS. 6 and 7, the control handle 1 carries a panel 27 disposed between right and left grips 1*a* and 1*b* and including a starter button 28 on a front face thereof. When the starter button 28 is pressed, the terminal "a" and terminal "c" of the switch SW1 are connected to switch to an operative position. A control lever 29 extends along the right grip 1*a* to be held together by the operator. When this lever 29 is operated, the switch SW1 is returned to the inoperative position with terminal "a" connected to terminal "b".

Figure 9:
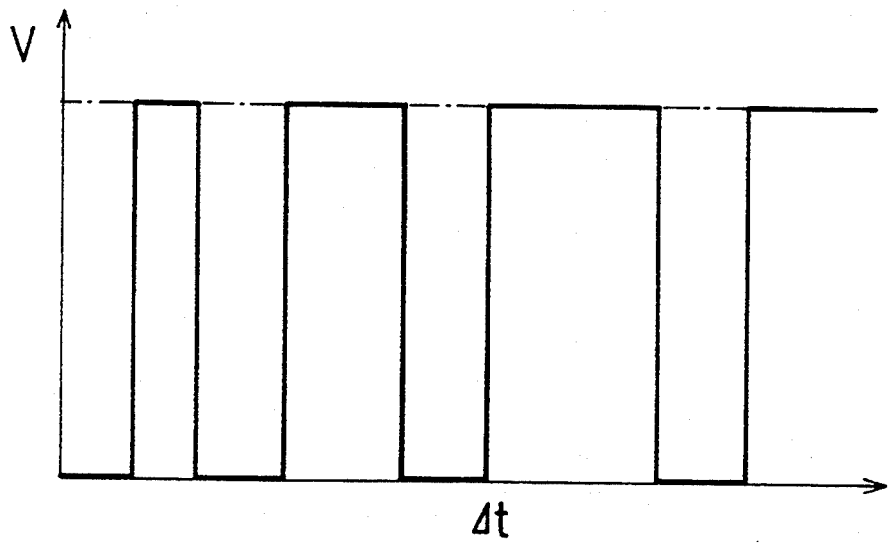
FIG. 9 is a view showing characteristics of a gate voltage.
Figure 10:
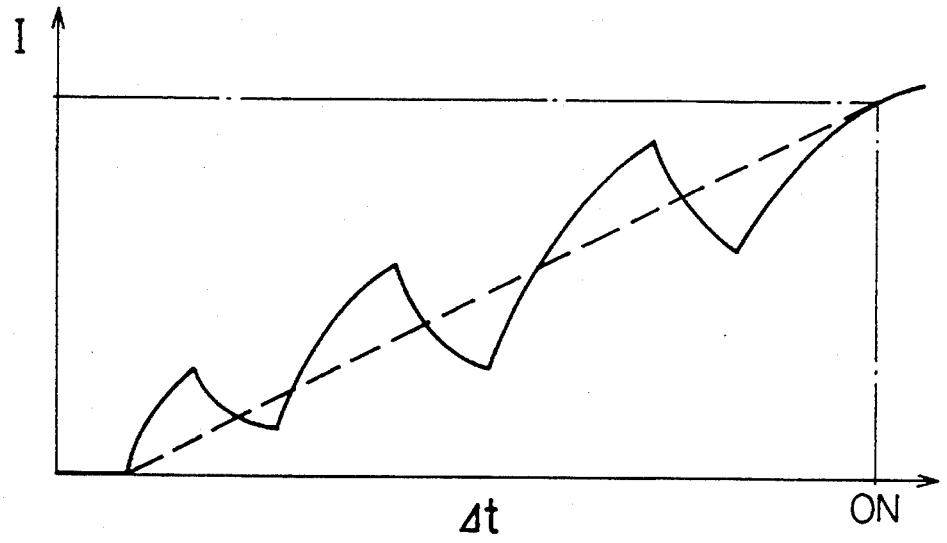
FIG. 10 is a view showing characteristics of a current flowing to an electric motor.

When the switch SW1 is turned to the operative position, the control circuit 25 supplies a pulsed voltage to a gate terminal G of the FET 17. As shown in FIG. 9, this pulsed voltage (V) has pulsewidths gradually enlarging from a starting point. Such pulsed voltage is applied to the gate terminal G, whereby the FET 17 becomes conductive only during the high level periods of the pulsed voltage, to supply a current to the electric motor 6. The current (I) flowing to the electric motor 6 has progressively increasing gradient characteristics as shown in FIG. 10, which is due to inductive impedance of the motor 6, and the rotating rate of the motor 6 increases correspondingly. A circuit constant is selected such that the predetermined operational rotating rate (120 rpm) is reached in 1 to 2 seconds after a start. The control circuit 23, FET 17 and switch SW1 constitute the rotating rate varying device A.

The mercury switch SW2 is turned on when the machine is in an operative posture with the floor contacting surface of the rotary brush 9 uniformly contacting the floor under treatment. When the machine is inclined in excess of a predetermined angle, the mercury switch SW2 is automatically turned off. Thus, the mercury switch SW2 acts as a safety device to stop the voltage supply to the gate terminal G of the FET 17 when the machine is inclined during an operation, thereby automatically stopping the rotary brush 9.

The control circuit 25 constantly receives voltage from the batteries 10. When the voltage of the batteries 10 lowers to a predetermined level, an alarm lamp 20 is automatically lit to notify the operator of the necessity to charge the batteries 10. At the same time, the voltage supply to the gate terminal G of the FET 17 is stopped to stop the electric motor 6. If, with the switch SW1 remaining in the inoperative position, the FET 17 should malfunction for some reason to short-circuit the source terminal S and drain terminal D, the fuse 14 would be broken to protect the electric motor 6 and other components of the circuit.

Figure 11:
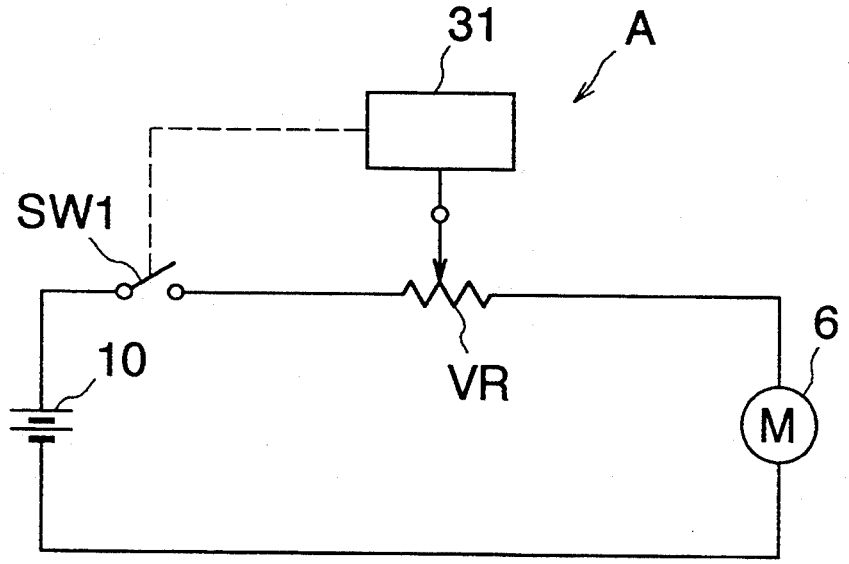
FIG. 11 is a diagram of a modified electric circuit.

FIG. 11 shows another example of rotating rate varying device A, which includes a variable resistor VR mounted in a wiring between the batteries 10 and electric motor 6. This variable resistor VR has a resistance mechanically variable by an actuator 31 connected to the switch SW1. Thus, with operation of the switch SW1, the variable resistor VR gradually increases the current flowing to the electric motor 6.

Figure 12:
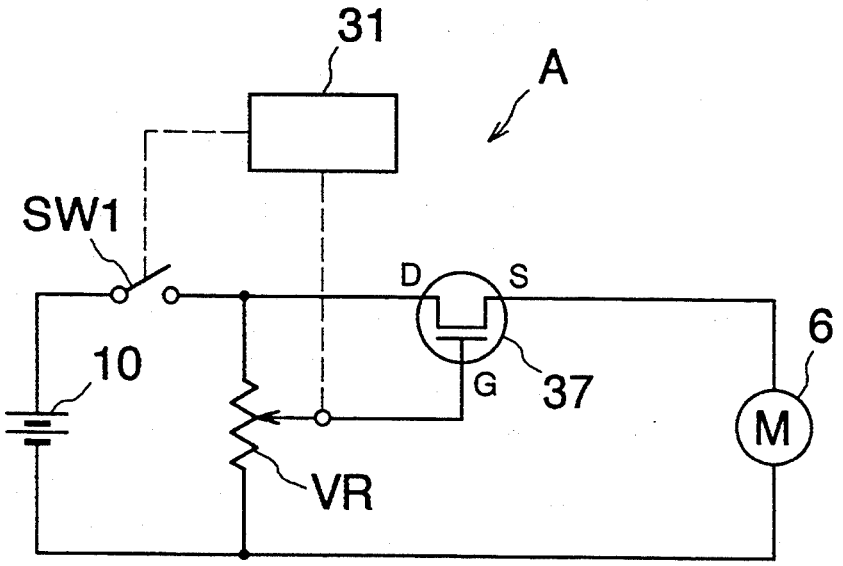
FIG. 12 is a diagram of a further modified electric circuit.

FIG. 12 shows yet another example of rotating rate varying device A, which includes a MOSFET 37 mounted in a wiring between the batteries 10 and electric motor 6, and a variable resistor VR connected parallel to the batteries 10. The variable resistor VR has an intermediate terminal connected to the gate terminal G of the FET 37. The variable resistor VR has a resistance mechanically variable by an actuator 31 operatively connected to the switch SW1.

A further embodiment of the present invention will be described hereinafter.

Figure 13:
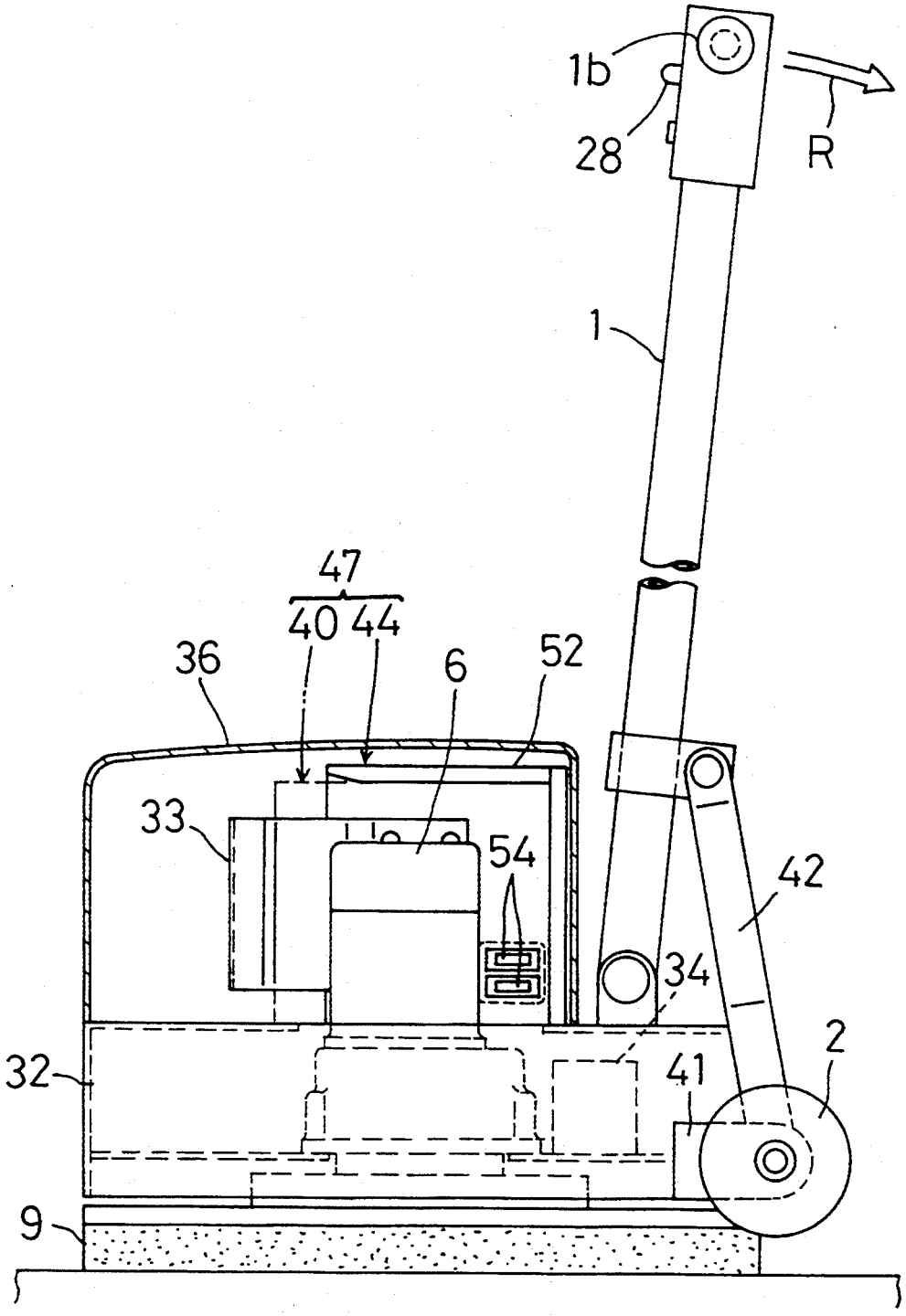
FIG. 13 is a side view, partly in section, of a floor treating rotary brush apparatus employing a battery mounting structure according to the present invention.
Figure 14:
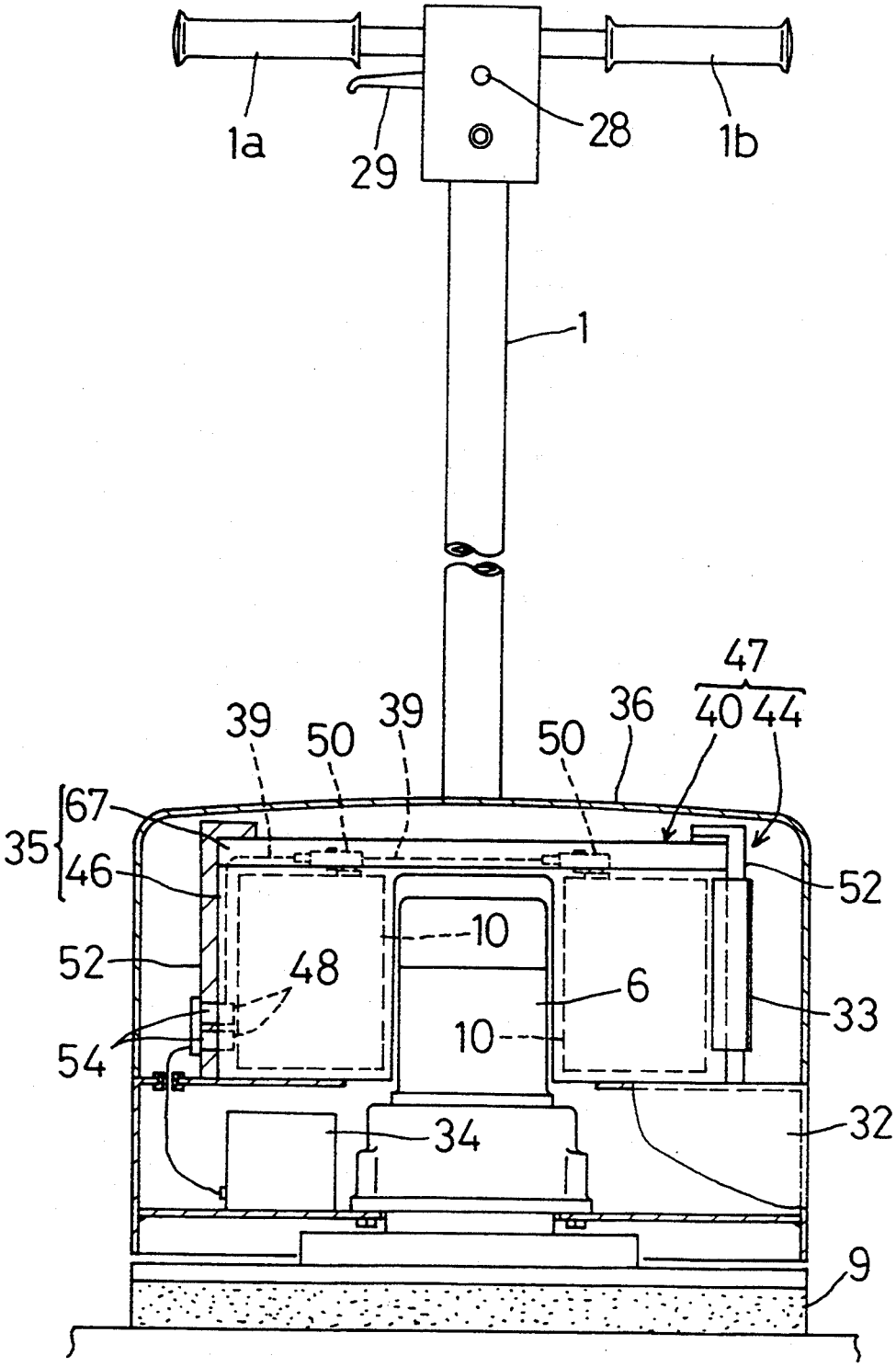
FIG. 14 is a front view, partly in section, of the apparatus shown in FIG. 13.
Figure 15:
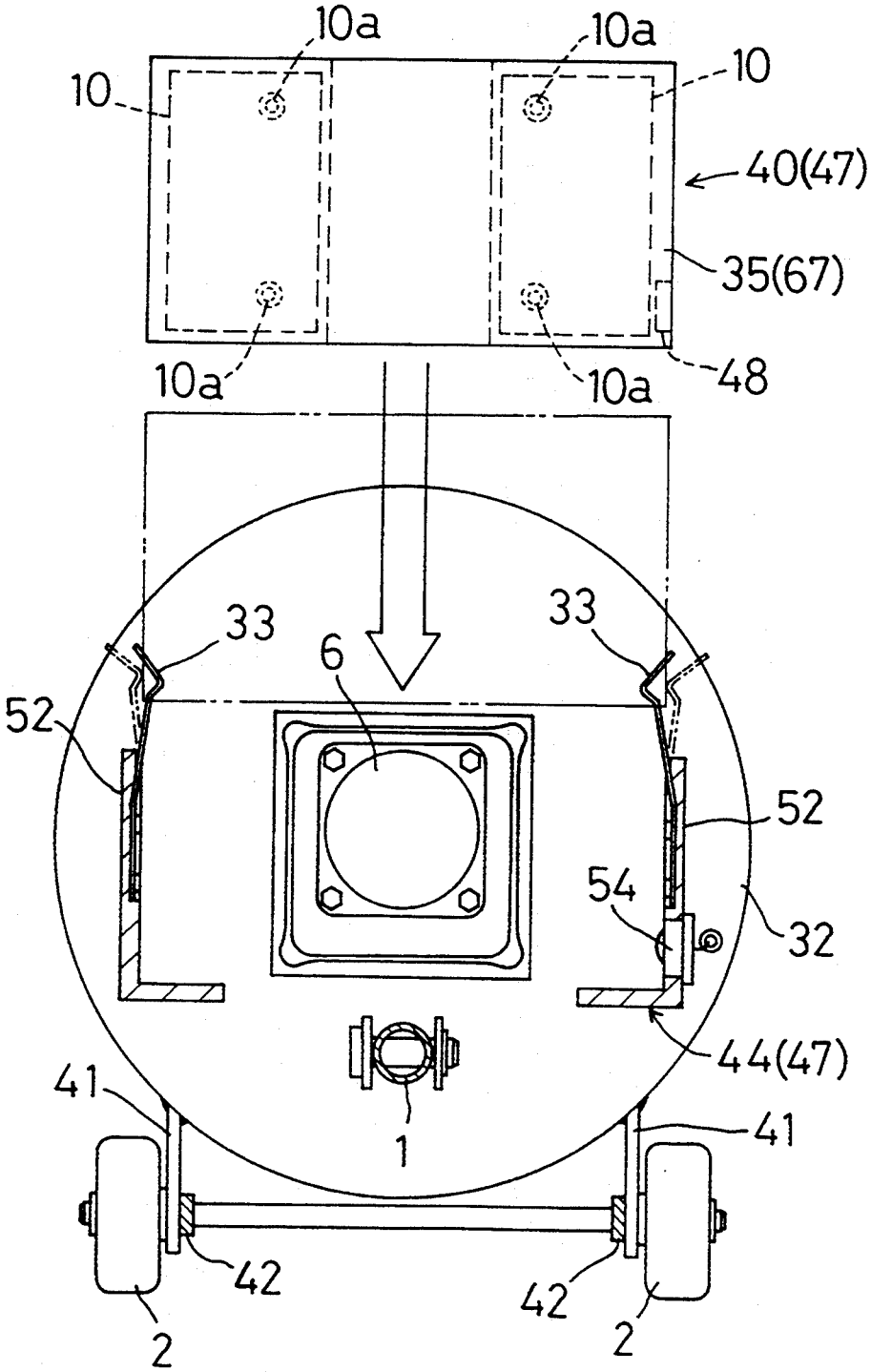
FIG. 15 is a plan view, partly in section, showing a principal portion of the battery mounting structure.

FIGS. 13 through 15 shows a floor treating rotary brush apparatus employing a battery mounting structure according to the invention. This apparatus has a control handle 1 connected to a main body 32 including a rotary brush 9 rotatable about a vertical axis, an electric motor 6 for driving the rotary brush 9, and a control unit 34 for controlling the motor 6. The main body 32 has an upper cover 36 enclosing a power source section 47.

The control handle 1 has a control switch 28 acting as a starter disposed on a front position thereof adjacent grips 1*a* and 1*b*, and a switch-off lever 29 extending alongside one of the grips 1*a* to be held together by the operator. The control handle 1 is connected at a proximal end thereof to the main body 32, and at an intermediate position through links 42 to a support member 41 for supporting casters 2. When the control handle 1 is swung in a direction of arrow R in FIG. 13, the casters 2 contact a floor surface to allow the apparatus to move with the rotary brush 9 lifted from the floor surface.

The power source section 47 includes a power receiving section 44 disposed on the main body 32, and a battery assembly 40 detachably attached to the power receiving section 44.

Figure 16:
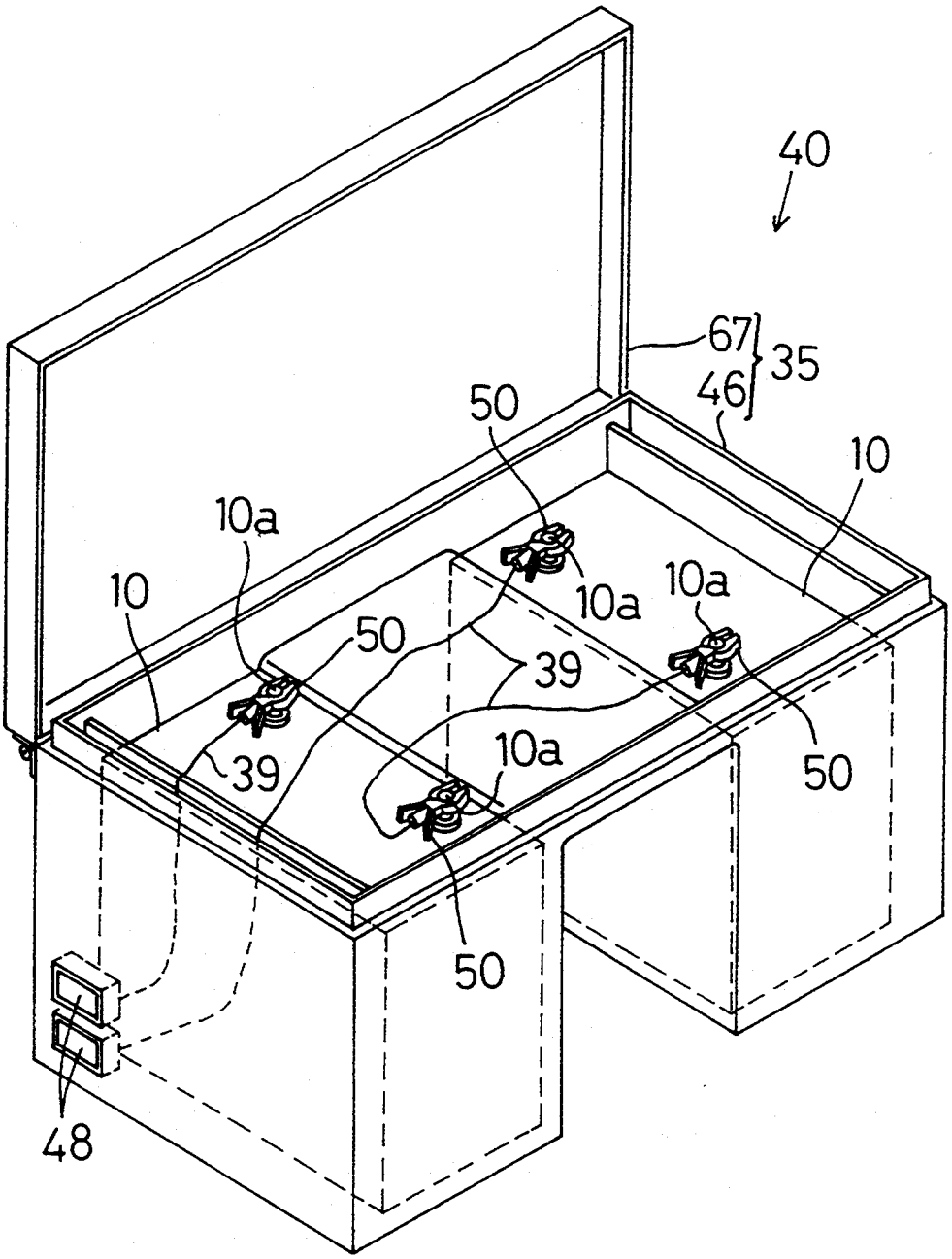
FIG. 16 is a perspective view of a battery assembly.

As shown in FIGS. 14 and 16, the battery assembly 40 includes a battery case 35 and batteries 10 mounted in the battery case 35. The battery case 35 includes a main case body 46 gate-shaped in side view and having an open top, and a lid 67 hinged to the main case body 46. The main case body 46 has a pair of contact terminals 48 exposed from a lateral wall thereof. Conductive wires 39 extending from the contact terminals 48 are partly embedded in the lateral wall, and then extend from an upper region of the lateral wall to terminals 10*a* of the batteries 10 mounted in the main case body 46, respectively. Another wire 39 extends between different terminals 10*a* of the batteries 10, thereby connecting the batteries 10 in series. These wires have metal clips 50 for connection to the terminals 10*a* of the batteries 10.

As shown in FIGS. 13 through 15, the power receiving section 44 accommodating the battery assembly 40 includes a stationary frame 52 having a front opening, and a pair of connecting terminals 54 disposed rearwardly or deep inside the stationary frame 52 for contacting the contact terminals 48 of the battery assembly 40. The opening of the power receiving section 44 has engaging pieces 33 formed of plate springs and disposed in a flexible state and inclined slightly toward the center of the opening as shown in solid lines in FIG. 15, to act as a fixing device for keeping the battery assembly 40 in place. Thus, the battery assembly 40 mounted in place is fixedly retained by the engaging pieces 33 acting on an end thereof adjacent the opening. In this position, the contact terminals 48 of the battery assembly 40 are maintained in contact with the connecting terminals 54 of the power receiving section 44.

The control unit 34 of the electric motor 6 receives power from the batteries 10 through the connecting terminals 54 of the power receiving section 44. The control unit 34 also receives signals from the starter switch 28 and switch-off lever 29 on the control handle 1 to control operation of the electric motor 6. That is, the electric motor 6 is started when the starter switch 28 is operated, and the power supply to the electric motor 6 is cut off immediately when the operator grips the switch-off lever 29.

Other embodiments will be described hereinafter.

Figure 17:
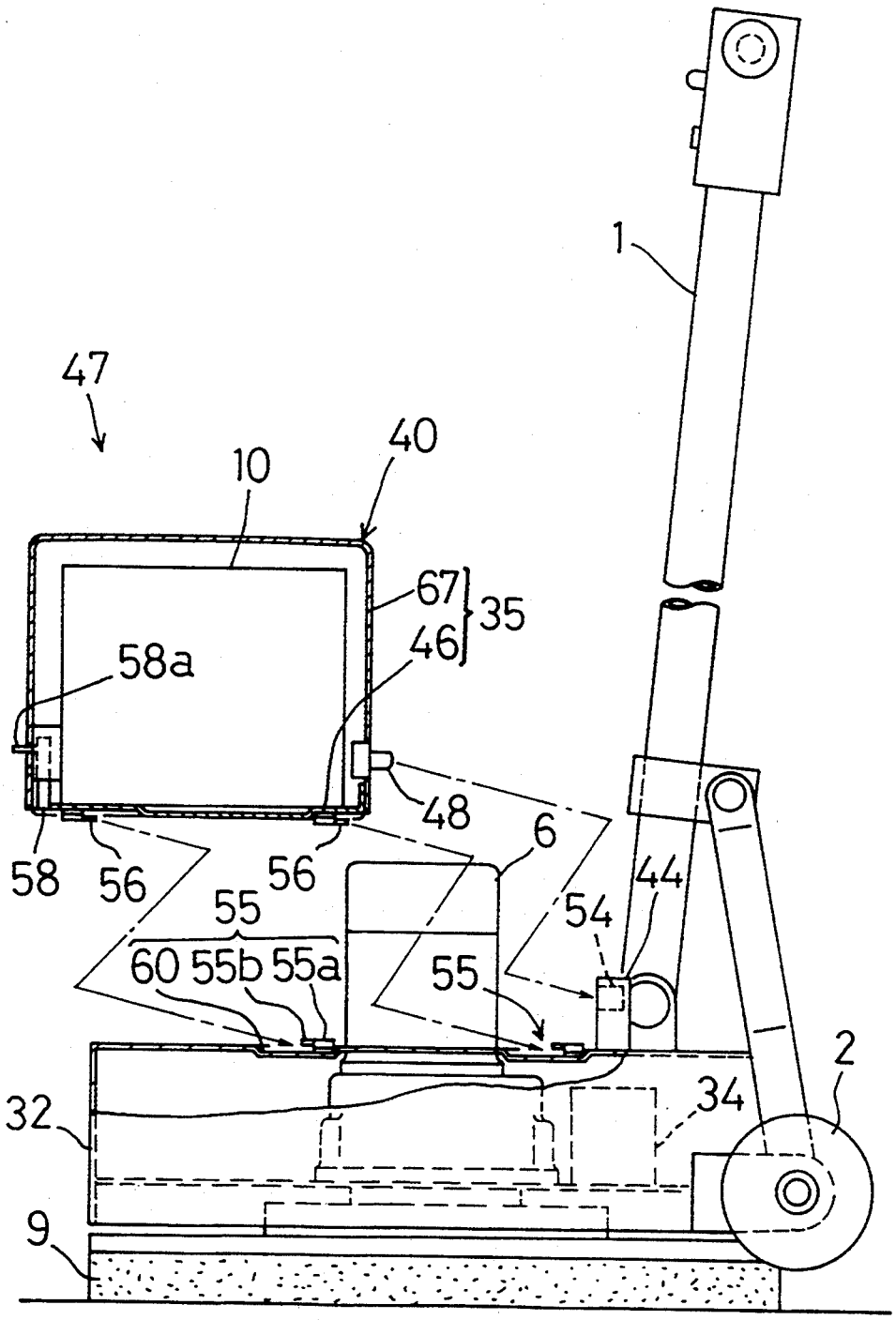
FIG. 17 is a side view, partly in section, of a floor treating rotary brush apparatus employing a battery mounting structure in a further embodiment of the invention.
Figure 18:
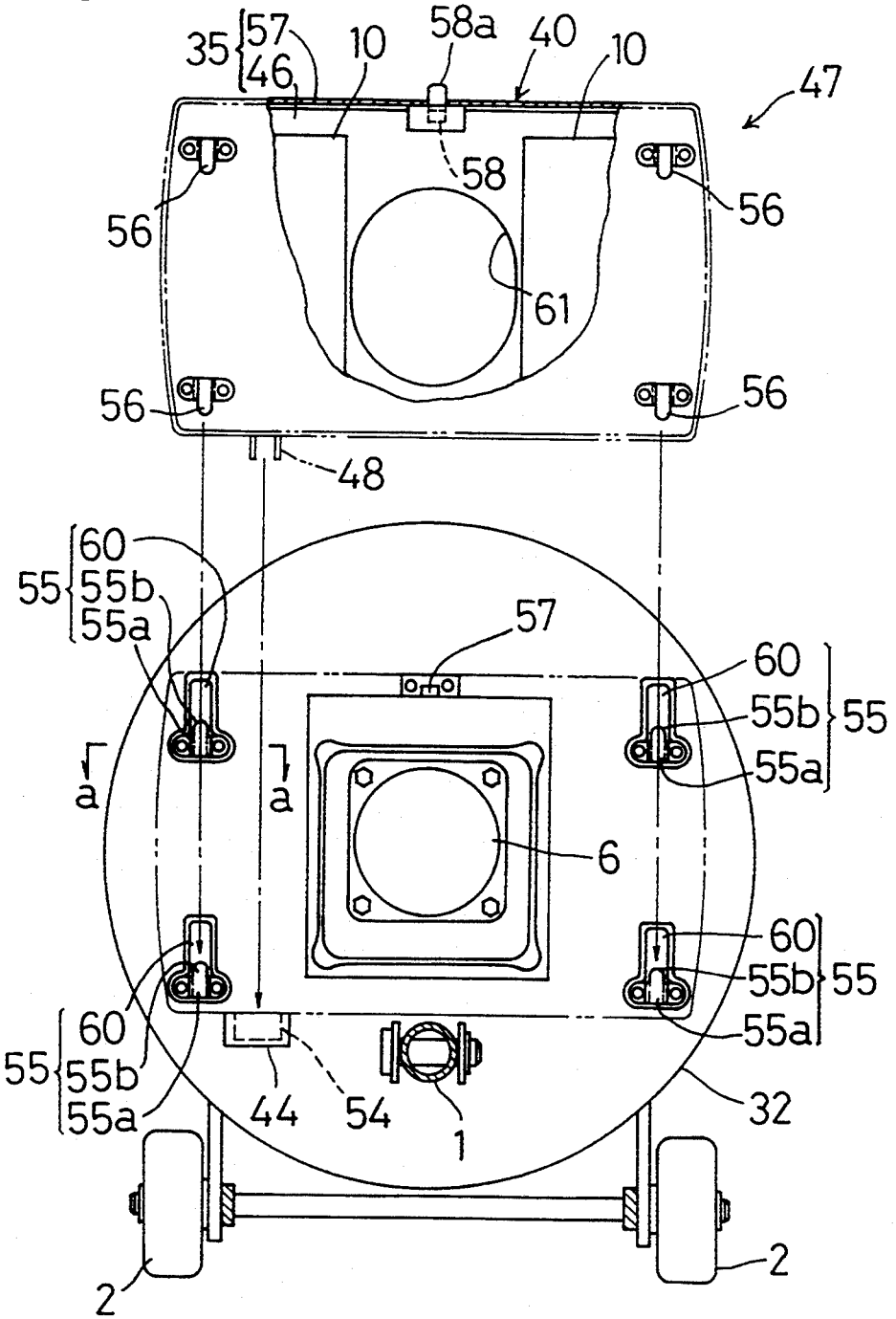
FIG. 18 is a plan view, partly in section, of the apparatus shown in FIG. 17.

[1] FIGS. 17 and 18 show a modified power receiving section 44 constituting the power source section 47 in combination with the battery assembly 40.

This power receiving section 44 includes no stationary frame 52 for fixedly storing the entire battery assembly 40. Instead, this power receiving section 44 has a fixing device including first main-body-side braces 55 arranged adjacent four corners of a battery supporting area of the upper surface of the main body 32, a second main-body-side brace 57 disposed in a position on the upper surface of the main body 32 corresponding to a lower middle position of the front of the battery assembly 40, first battery-side braces 56 arranged adjacent the four corners of a bottom surface of the battery assembly 40, and a second battery-side brace 58 disposed in the lower middle position of the front of the battery assembly 40. The power receiving section 44 also has socket type connecting terminals 54 disposed on the upper surface of the main body 32 for receiving and connecting to contact terminals 48 of the battery assembly 40.

Figure 19:
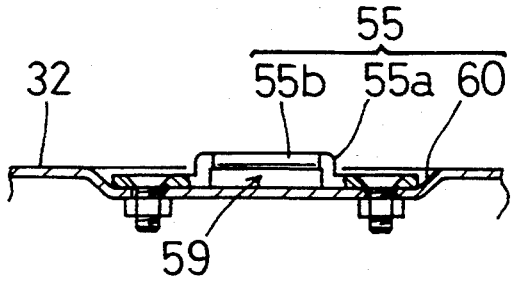
FIG. 19 is a section taken on line a—a of FIG. 18.

As shown in FIGS. 17 through 19, each of the first main-body-side braces 55 includes a stationary piece 55*a* having a central portion thereof slightly elevated from the upper surface of the main body 32 to define an engaging space 59 therebetween for receiving part of the corresponding first battery-side brace 56, and a guide groove 60 for guiding the battery-side brace 56 in sliding into and out of engagement with the engaging space 59. The stationary piece 55*a* includes a projection 55*b* formed centrally and forwardly thereof for engaging a similar engaging space 59 formed in the battery-side brace 56.

Each of the first battery-side braces 56 has a construction identical to that of the first main-body-side brace 55, and attached to the bottom surface of the main case body 46 of the battery case 35 in the opposite direction to the first main-body-side brace 55.

The second main-body-side brace 57 is simply a recess, while the second battery-side brace 58 is a drop bar for engaging the recess. The second braces 57 and 58 are disengageable by raising the drop bar by a catch 58*a* formed thereon, and engageable by pressing the drop bar downward. The second braces 57 and 58, when engaged, maintain the first braces 55 and 56 engaged to restrict horizontal movement of the entire battery assembly 40.

The battery assembly 40 in this embodiment has a box-shaped battery case 35 for containing batteries 10. The battery case 35 includes a box-shaped lid 47 having an open bottom, which is fitted over and secured to the main case body 46.

The contact terminals 48 project from a rear surface of the main case body 46 (forwardly in the direction in which the first battery-side braces 56 move for engagement) for connection to the connecting terminals 54 of the power receiving section 44. The second battery-side brace 58 is disposed on the front of the main case body 46. Further, the main case body 46 defines an opening 61 centrally of the bottom surface thereof, which opening has a larger diameter than an outside diameter of the electric motor 6. This opening 61 is spaced from the electric motor 6 to an extent for allowing the battery assembly 40 mounted on the main body 32 to slide back and forth to engage the braces.

According to this embodiment, when the battery assembly 40 is mounted in place, the battery case 35 entirely covers the electric motor 6. Thus, the cover 36 in the preceding embodiment may be omitted from this embodiment.

[2] The battery assembly 40 may contain one battery or three or more batteries instead of two.

[3] The battery assembly 40 may include only the batteries 10 without the battery case. In this case, the terminals of the batteries 10 act as the contact terminals 48 for connection to the connecting terminals 54 of the power receiving section 44.

[4] The engaging pieces 33 of the power receiving section 44 are not limited to the elastic type, but may be any other type only if capable of maintaining the battery assembly 40 in place.

[5] The floor treating rotary brush apparatus is not limited to the type manually operable through the control handle 1, but may be a self-propelled type, e.g. one operable by radio control.

What is claimed is:

1. A floor treating machine comprising:

an electric motor, said motor being a DC motor having a speed reducer;

a rotary shaft extending vertically and driven by said electric motor;

a floor treating device detachably attached to a lower end of said rotary shaft to be rotatable therewith, said floor treating device contacting a floor surface and entirely supporting the machine during a floor treatment operation; and at least a pair of batteries mounted on a motor deck for supplying a current to said electric motor;

wherein said batteries are arranged symmetrically across a line extending through a control handle and said rotary shaft in plane view such that said rotary shaft is positioned within a range defined by a line extending through forward ends of said batteries and a line extending through rearward ends of said batteries, wherein said electric motor is connected to said batteries through an on/off switch, and wherein the entire weight of the machine is supported solely through said floor treating device during the floor treatment operation with a floor contacting portion thereof substantially uniformly contacting the floor.

2. A floor treating machine as claimed in claim 1, wherein during operation, said electric motor provides a speed of about 120 rpm.

* * * * *